US005701757A

United States Patent [19]

Heverly

[11] Patent Number: 5,701,757

[45] Date of Patent: Dec. 30, 1997

[54] PORTABLE REFRIGERATER FOOD CONTAINER

[76] Inventor: Marilou Heverly, 129 Cresston Rd., Arnold, Md. 21012

[21] Appl. No.: 672,553

[22] Filed: Jun. 28, 1996

[51] Int. Cl.[6] ..... F25D 3/08

[52] U.S. Cl. ..... 62/457.2; 62/457.6; 62/371; 220/528; 220/400

[58] Field of Search ..... 62/457.2, 457.6, 62/457.7, 371, 530, 529; 126/369, 377; 220/326, 324, 319, 400, 528, 380

[56] References Cited

U.S. PATENT DOCUMENTS 1,737,240 11/1929 Hois ..... 126/377

5,307,647 5/1994 McClure ..... 62/457.6

FOREIGN PATENT DOCUMENTS 29 25 499 1/1981 Germany .

*Primary Examiner*—John M. Sollecito

[57] ABSTRACT

A new Portable Food Refrigeration System for facilitating cooling of food when a refrigerator is unavailable thereby preventing the food from melting and becoming unappealing. The inventive device includes an outer pan formed to receive a frozen gel pack on the bottom surface, and an inner pan removably positioned within the outer pan juxtaposed the frozen gel pack where the inner pan creates a seal with the outer pan preventing the escape of cooled air from between the pans.

6 Claims, 3 Drawing Sheets

FIG 3
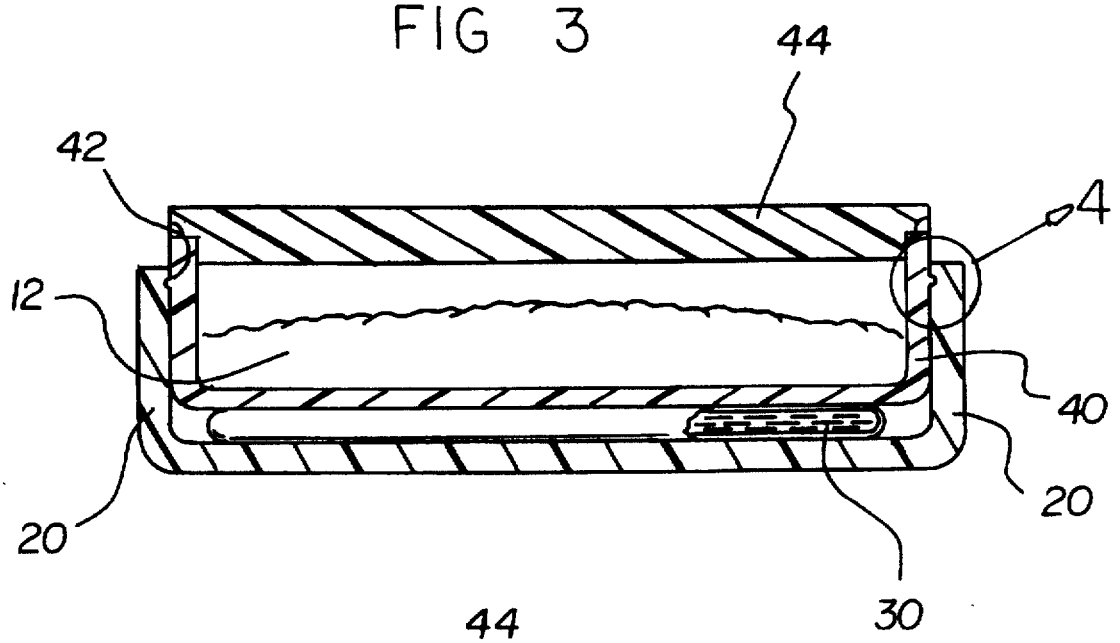
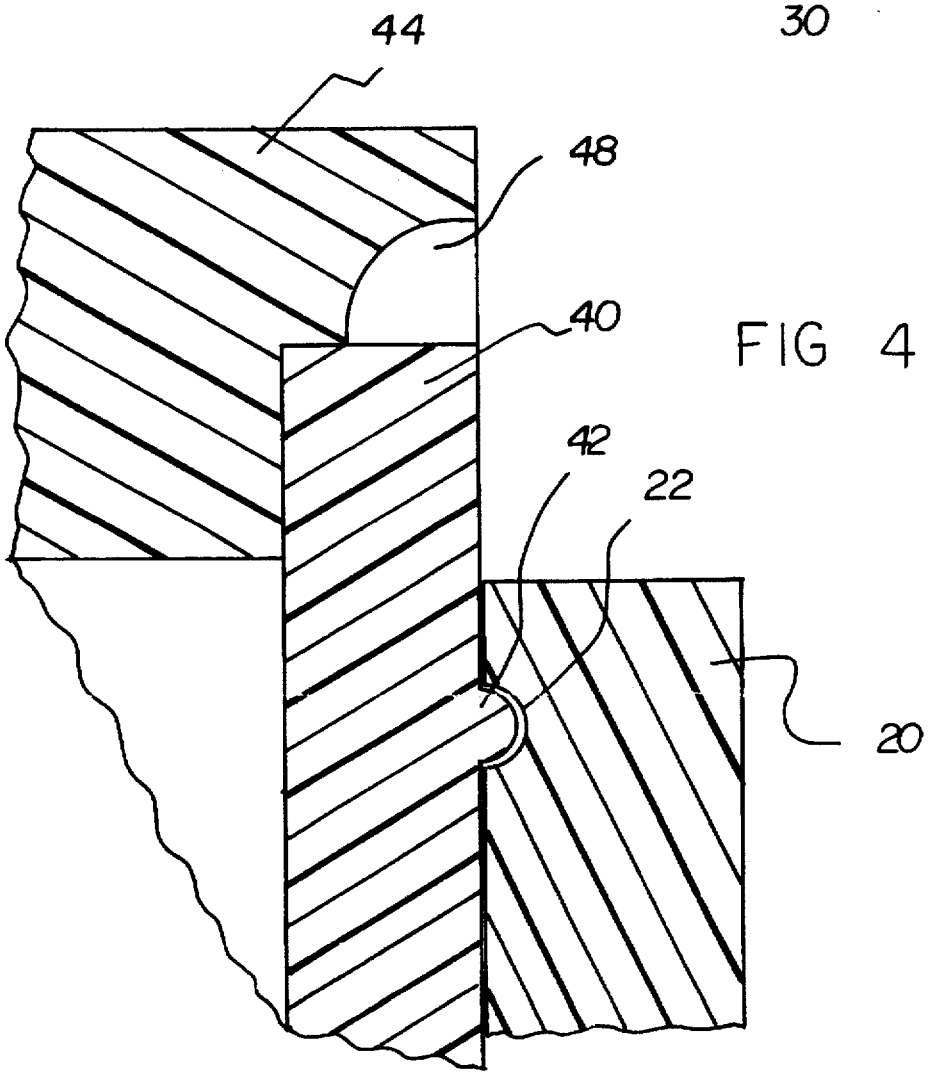
FIG 4

PORTABLE REFRIGERATER FOOD CONTAINER

BACKGROUND OF THE INVENTION

1. Field of the Invention

The present invention relates to Refrigeration Devices and more particularly pertains to a new Portable Food Refrigeration System for facilitating cooling of food when a refrigerator is unavailable thereby preventing the food from melting and becoming unappealing.

2. Description of the Prior Art

The use of Refrigeration Devices is known in the prior art. More specifically, Refrigeration Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Refrigeration Devices include U.S. Pat. Nos. 4,331,127; 3,946,893; 280,688; 3,934,748; 4,823,980 and 5,247,807.

While these devices fulfill their respective, particular objectives and requirements, the aforementioned patents do not disclose a new Portable Food Refrigeration System. The inventive device includes an outer pan formed to receive a frozen gel pack on the bottom surface, and an inner pan removably positioned within the outer pan juxtaposed the frozen gel pack where the inner pan creates a seal with the outer pan preventing the escape of cooled air from between the pans.

In these respects, the Portable Food Refrigeration System according to the present invention substantially departs from the conventional concepts and designs of the prior art, and in so doing provides an apparatus primarily developed for the purpose of facilitating cooling of food when a refrigerator is unavailable thereby preventing the food from melting and becoming unappealing.

SUMMARY OF THE INVENTION

In view of the foregoing disadvantages inherent in the known types of Refrigeration Devices now present in the prior art, the present invention provides a new Portable Food Refrigeration System construction wherein the same can be utilized for facilitating cooling of food when a refrigerator is unavailable thereby preventing the food from melting and becoming unappealing.

The general purpose of the present invention, which will be described subsequently in greater detail, is to provide a new Portable Food Refrigeration System apparatus and method which has many of the advantages of the Refrigeration Devices mentioned heretofore and many novel features that result in a new Portable Food Refrigeration System which is not anticipated, rendered obvious, suggested, or even implied by any of the prior art Refrigeration Devices, either alone or in any combination thereof.

To attain this, the present invention generally comprises an outer pan formed to receive a frozen gel pack on the bottom surface, and an inner pan removably positioned within the outer pan juxtaposed the frozen gel pack where the inner pan creates a seal with the outer pan preventing the escape of cooled air from between the pans.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Portable Food Refrigeration System apparatus and method which has many of the advantages of the Refrigeration Devices mentioned heretofore and many novel features that result in a new Portable Food Refrigeration System which is not anticipated, rendered obvious, suggested, or even implied by any of the prior art Refrigeration Devices, either alone or in any combination thereof.

It is another object of the present invention to provide a new Portable Food Refrigeration System which may be easily and efficiently manufactured and marketed.

It is a further object of the present invention to provide a new Portable Food Refrigeration System which is of a durable and reliable construction.

An even further object of the present invention is to provide a new Portable Food Refrigeration System which is susceptible of a low cost of manufacture with regard to both materials and labor, and which accordingly is then susceptible of low prices of sale to the consuming public, thereby making such Portable Food Refrigeration System economically available to the buying public.

Still yet another object of the present invention is to provide a new Portable Food Refrigeration System which provides in the apparatuses and methods of the prior art some of the advantages thereof, while simultaneously overcoming some of the disadvantages normally associated therewith.

Still another object of the present invention is to provide a new Portable Food Refrigeration System for facilitating cooling of food when a refrigerator is unavailable thereby preventing the food from melting and becoming unappealing.

Yet another object of the present invention is to provide a new Portable Food Refrigeration System which includes an outer pan formed to receive a frozen gel pack on the bottom surface, and an inner pan removably positioned within the outer pan juxtaposed the frozen gel pack where the inner pan creates a seal with the outer pan preventing the escape of cooled air from between the pans.

Still yet another object of the present invention is to provide a new Portable Food Refrigeration System where the outer pan and the inner pan may be utilized separately in the preparation and storage of food.

Even still another object of the present invention is to provide a new Portable Food Refrigeration System that is usable during pot luck dinners and picnics.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2 disclosing the sealing cincture positioned within the sealing rabbet.

FIG. 4 is a magnified view of the sealing cincture and the sealing rabbet in cooperation.

DESCRIPTION OF THE PREFERRED EMBODIMENT

Figure 1:
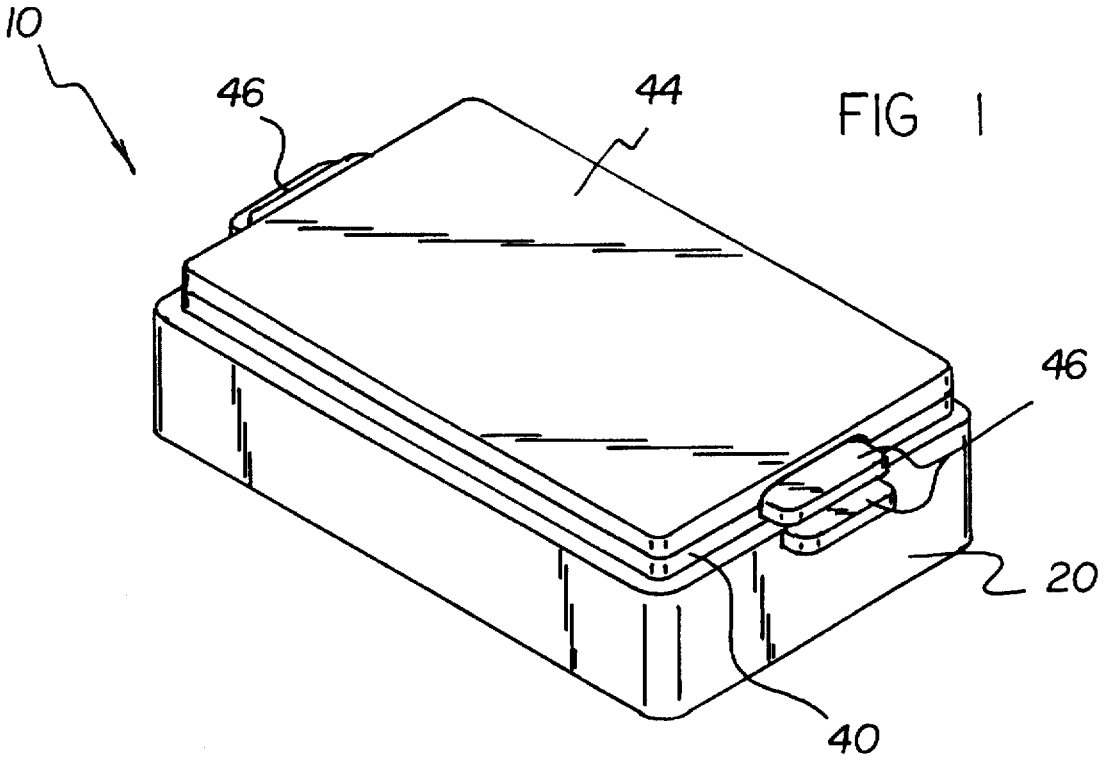
FIG. 1 is a side perspective view of a new Portable Food Refrigeration System according to the present invention.
Figure 2:
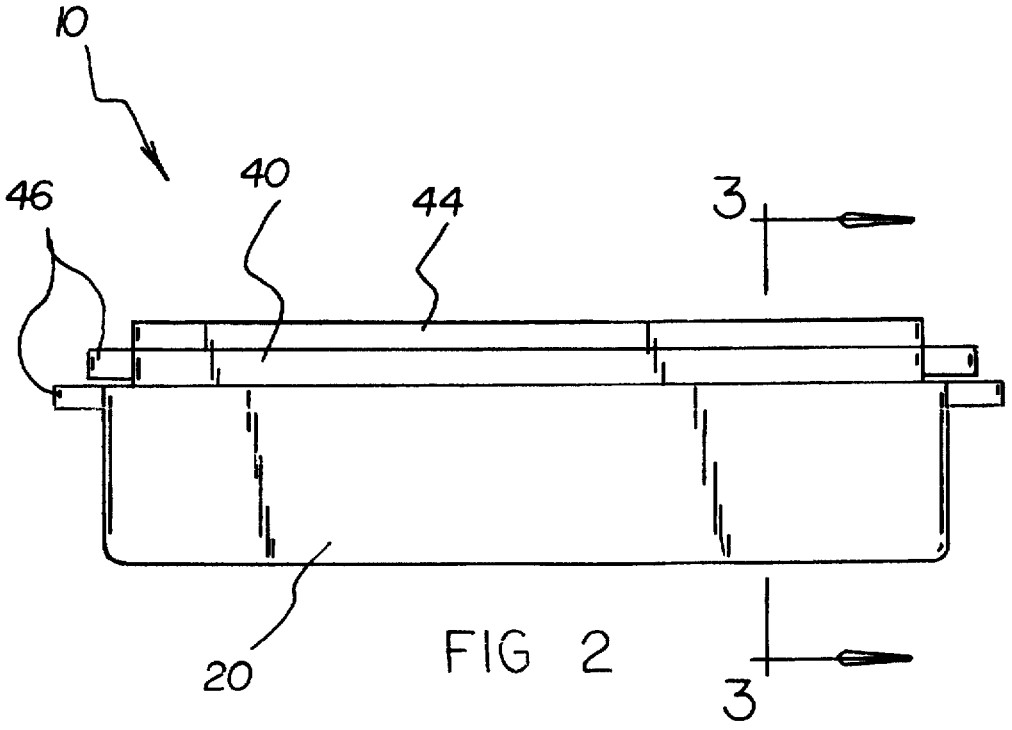
FIG. 2 is a side view thereof.
Figure 5:
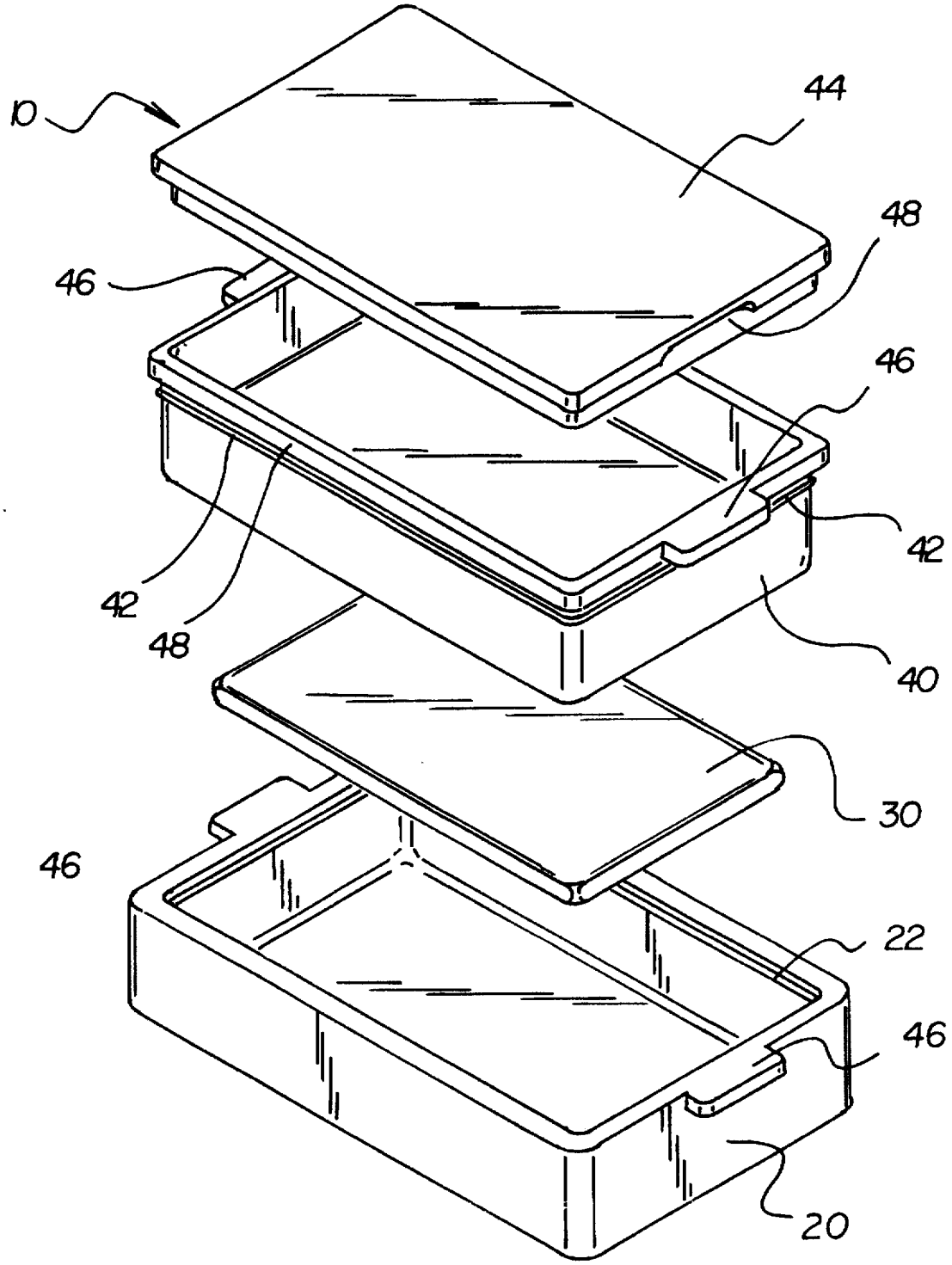
FIG. 5 is an exploded isometric view of the present invention.

With reference now to the drawings, and in particular to FIGS. 1 through 5 thereof, a new Portable Food Refrigeration System embodying the principles and concepts of the present invention and generally designated by the reference numeral 10 will be described.

More specifically, it will be noted that the Portable Food Refrigeration System 10 comprises an outer pan 20 constructed from a rigid insulating material including at least one handle 46 secured to the upper exterior portion, a gel pack 30 removably positioned on the interior bottom surface which is freezable, and an inner pan 40 formed to a shape similar to the outer pan 20 which retains food 12 including at least one handle 46 secured to the upper exterior portion, and slidably positionable within the outer pan 20 juxtaposed to the gel pack 30.

As best illustrated in FIGS. 3–4, it can be shown that the outer pan 20 includes a sealing rabbet 22 near the upper edge. The inner pan 40 includes a sealing cincture 42 near the upper edge which mates with the sealing rabbet 22 forming an air tight seal when the inner pan 40 is positioned within the outer pan 20 as best disclosed in FIG. 4 of the drawings. The inner pan 40 includes an insulated lid 44 which includes a grip depression 48 for the user to grasp the insulated lid 44. The inner pan 40 and the outer pan 20 are preferably constructed from a rigid plastic. The outer pan 20 is preferably rectangular shaped, and the inner pan 40 is rectangular shaped formed to removably fit within the outer pan 20.

In use, the user places the gel pack 30 within an unnumbered freezer. Upon freezing of the gel pack 30, the user positions the frozen gel pack 30 on the bottom surface of the outer pan 20. The user then positions the inner pan 40 within the outer pan 20 with the inner pan 40 juxtaposed the frozen gel pack 30. The sealing cincture 42 mates with the sealing rabbet 22 thereby preventing the cool air from escaping. The insulated lid 44 is then placed on top of the inner pan 40 sealing the food 12 within.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Portable Food Refrigeration System comprising:

an outer pan constructed from a rigid insulating material including at least one handle secured to the upper exterior portion;

a gel pack removably positioned on the interior bottom surface which is freezable; and an inner pan formed to a shape similar to the outer pan for retaining food and including at least one handle secured to the upper exterior portion, said inner pan being slidably positionable within in the interior of the outer pan to produce a nested relationship between said inner and outer pans;

wherein one of said pans has a sealing protrusion located substantially adjacent to and along the upper edge of said one pan and the other of said pans has a sealing groove located substantially adjacent to and along the upper edge of said other pan such that when said pans are placed in a nested relationship said sealing groove and said sealing protrusion are moved into a mated condition, wherein the mated condition of said sealing protrusion and said sealing groove forms a substantially air tight barrier and resists movement of said inner pan out of the nested relationship with said outer pan.

2. The Portable Food Refrigeration System of claim 1, wherein said sealing protrusion has a semicircular convex profile and said sealing groove has a semicircular concave profile.

3. The Portable Food Refrigeration System of claim 1 wherein the sealing protrusion is located on the outer surface of said inner pan and said sealing groove is located on the inner surface of the outer pan.

4. The Portable Food Refrigeration System of claim 1, wherein the inner pan includes an insulated lid which includes a grip depression for the user to grasp the insulated lid.

5. The Portable Food Refrigeration System of claim 1, wherein the inner pan and the outer pan are constructed from a rigid plastic.

6. The Portable Food Refrigeration System of claim 1, wherein the outer pan is rectangular shaped, and the inner pan is rectangular shaped formed to removably fit within the outer pan.

* * * * *